United States Patent [19]

Schmitt et al.

[11] 3,970,066

[45] July 20, 1976

[54] RPM REGULATOR FOR FUEL INJECTION PUMPS

[75] Inventors: Edgar Schmitt, Moglingen; Karl Konrath, Ludwigsburg, both of Germany

[73] Assignee: Robert Bosch G.m.b.H., Stuttgart, Germany

[22] Filed: Sept. 24, 1974

[21] Appl. No.: 508,891

[30] Foreign Application Priority Data

Oct. 3, 1973 Germany ..... 2349655

[52] U.S. Cl. ..... 123/140 A; 123/139 AD; 123/139 AF; 123/139 BD

[51] Int. Cl.[2] ..... F02D 1/04

[58] Field of Search..... 123/140 R, 140 A, 140 FG, 123/139 BD, 139 AP, 139 AD, 139 AR, 139 AB, 139 AF, 139 AA, 139 AC

[56] References Cited

UNITED STATES PATENTS

| | | | |
|---|---|---|---|
| 2,870,651 | 1/1959 | Lasek | 123/140 R |
| 3,613,651 | 10/1971 | Snyder et al. | 123/140 R |
| 3,638,631 | 2/1972 | Eheim | 123/140 A X |
| 3,830,211 | 8/1974 | Bechstein et al. | 123/140 R |
| R23,889 | 10/1954 | Seaver | 123/140 R |

*Primary Examiner*—Charles J. Myhre
*Assistant Examiner*—Tony Argenbright
*Attorney, Agent, or Firm*—Edwin E. Greigg

[57] ABSTRACT

An improved rpm regulator for a fuel injection pump associated with an internal combustion engine. The regulator includes an intermediate lever, a fuel quantity control sleeve conncted to the intermediate lever, a regulating spring connected to the intermediate lever, a device for generating an rpm signal and applying a force corresponding therewith through the intermediate lever to the fuel quantity control sleeve in opposition to a force exerted by the regulating spring, a control lever, an adjustable stop mounted to the housing and a biasing spring. The intermediate lever is mounted to the control lever which in turn is mounted to the pump housing and is biased against the adjustable stop by the biasing spring.

5 Claims, 3 Drawing Figures

RPM REGULATOR FOR FUEL INJECTION PUMPS

BACKGROUND OF THE INVENTION

The present invention relates to an rpm regulator for fuel injection pumps associated with internal combustion engines of the type having an intermediate lever pivotably mounted about an adjustable shaft to which a fuel quantity control sleeve is coupled and a device for generating an rpm signal and applying a force corresponding therewith against the force of a regulator spring to the intermediate lever and thereby to the fuel quantity control sleeve.

In a known rpm regulator of the aforenoted type, the intermediate lever is mounted on a pin arranged eccentrically on a shaft mounted within the pump housing. Rotation of the eccentric shaft changes the normal setting of the fuel quantity control sleeve. The disadvantage of this arrangement lies in the fact that the shaft with the pin extending eccentrically from its frontal surface must be installed in the pump housing without any play, and requires high precision in the manufacture thereof. Furthermore, for precise installation it is necessary that on the exterior of the pump housing there must be provided a sufficiently long actuating lever for the shaft, which under rough conditions is susceptible to undesired displacement.

OBJECTS AND SUMMARY OF THE INVENTION

It is, therefore, an object of the present invention to provide an rpm regulator of the aforenoted type which is free of the above-noted disadvantages.

It is another object of the present invention to provide an rpm regulator of the aforenoted type which is easily and reliably serviceable, and which provides savings in the manufacture and mounting costs of the regulator.

It is still another object of the present invention to provide an rpm regulator of the aforenoted type according to which precise adjustment is possible.

These and other objects are accomplished according to the present invention by the provision of a control lever in the rpm regulator to which the intermediate lever is mounted by a shaft, which control lever is pivotable about its own mounting shaft by the force of at least one spring against an adjustable stop.

Such an arrangement has the advantage that the adjustment assembly consists of a cost saving and easily producible lever which is securely mounted within the pump housing against any arbitrary movements. The presence of a spring urging the control lever against the displaceable stop eliminates any play which might otherwise be present in the control lever arrangement.

A preferred novel embodiment of the present invention consists in that the control lever is a two-armed lever, one arm of which is associated with the adjustable stop and the other arm of which engages the spring. In this preferred arrangement the shaft of the intermediate lever is disposed thereon between a fuel quantity control sleeve of the pump and the shaft of the control lever. Preferably, the shaft of the intermediate lever is disposed in close proximity to the fuel quantity control sleeve thus holding the most favorable transfer relation between the shaft and the fuel quantity control sleeve.

A further preferred novel embodiment of the present invention consists in that the control lever shaft is pressed into at least one V-shaped recess of the pump housing by means of at least one lever arm engaging spring. In this manner a costly precision machining process and an additional sealing of the control lever shaft, which traverses the pump housing, is avoided; while at the same time achieving an arrangement which if free-of-play. Additionally, the mounting is also considerably simplified.

A still further novel embodiment of the present invention consists in that a pair or V-shaped recesses are formed in the pump housing and in that a compression spring is associated with each one of the V-shaped recesses to actuate the control lever into engagement with the V-shaped recesses. This results in that both resting locations of the control lever in the V-shaped recesses are evenly loaded and that a secure arrangement of the control lever in the pump housing is achieved.

The invention will be better understood and further objects as well as advantages will become more apparent from the ensuing detailed specification of the preferred embodiments of the invention, taken in conjunction with the drawing.

DESCRIPTION OF THE PREFERRED EMBODIMENTS

Figure 1:
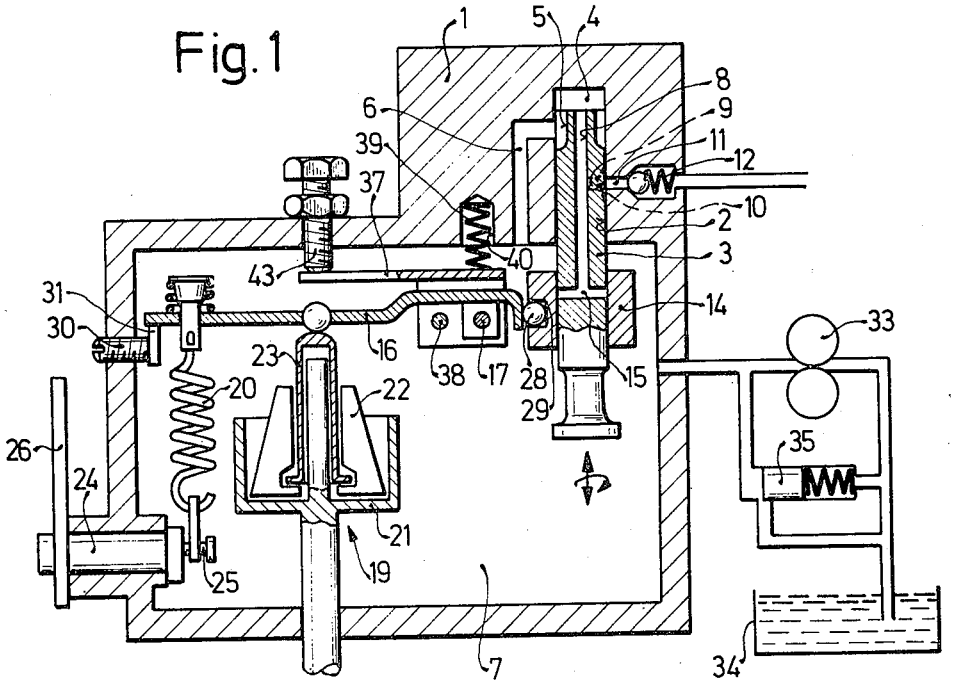
FIG. 1 is a schematic sectional view of one preferred embodiment of the present invention.

Turning now to FIG. 1, there is shown a housing 1 of a fuel injection pump within which certain of the operative elements are housed. The housing 1 includes a bore 2 within which a pump piston 3 is set for simultaneous rotating and reciprocating motion by means (not shown) against the force of a return spring (also not shown). The bore 2 and piston 3 define a pump working chamber 4. The pump working chamber 4 is supplied with fuel from a suction chamber 7 via a respective one of a plurality of longitudinal grooves 5 and a bore 6. The suction chamber 7 and a bore 6 are formed in the housing 1, and the grooves 5 are formed in the outer surface of the pump piston 3. The fuel is supplied to the working chamber 4 during the suction strokes of the piston 3 and while it occupies its bottom dead-center position. During the pressure stroke of the piston 3 and upon a corresponding rotation of the piston 3, the bore 6 is closed or hydraulically disconnected from the grooves 5. Under these conditions, the fuel present in the working chamber 4 is fed into a longitudinal channel 8 formed in the pump piston 3. From the longitudinal channel 8 the fuel flows through a branching-off radial bore 9 and a longitudinal distributing groove 10, both formed in the wall of the pump piston 3, to one of several pressure conduits 11. From the respective conduit 11, the fuel is forced past a check valve 12 and discharged into a corresponding bore 12 which leads to a corresponding fuel injection valve (not shown) of the internal combustion engine. There are of course as many conduits 11 and corresponding bores 12, distributed about the circumference of the housing 1, as cylinders of the internal combustion engine.

The suction chamber 7 is provided with fuel from the fuel tank 34 via a fuel pump 33. The pressure in the suction chamber 7 is regulated in a known manner by means of a pressure regulating valve 35, so that the pressure in the chamber 7 increases with increasing rpm of the engine.

On the pump piston 3 there is mounted a displaceable annular control sleeve 14 which controls, during the pressure stroke of the piston 3, a radial bore 15 connected to the longitudinal axial bore 8 and thereby governs the supply end, i.e., the fuel supply quantity. The control excess fuel flows back into the suction chamber 7.

The control sleeve 14 is displaced by means of an intermediate lever 16 which is pivotably mounted to a shaft 17 which defines an axis of rotation for the lever 16. A centrifugal governor 19 is provided and serves as an rpm signal generator which applies a corresponding force to the lever 16, and actuates the lever 16 against the force of a regulating spring 20. The governor 19 includes a carrier 21 for centrifugal weights 22. The carrier 21 is driven with a speed identical to the pump rpm in a known manner. The centrifugal weights 22 are controlled in their swinging motion by centrifugal force and displace a governor sleeve 23 engaged at the lever 16 against the force of the regulating spring 20. To enable adjustment of the preload of the regulating spring 20, one end of the spring 20 is fixed to an eccentrically disposed bolt 25, which extends outwardly from a frontal side of a shaft 24. The shaft 24 is mounted to the pump housing 1 and extends outside of the pump housing where it receives one end of a lever 26. Rotation of the lever 26 causes rotation of the shaft 24.

The lever 16 is provided on the end adjacent the control sleeve 14 with a spherical head 28 which head is received within a recess 29 of the control sleeve 14. Pivotal motion of the intermediate lever 16 causes axial displacement of the control sleeve 14 relative to the piston 3. This displacement is utilized to alter the timing of the fuel delivered by the pump, depending upon the opening of the radial bore 15. When the radial bore 15 is opened, fuel supply to the pressure conduits 11 is interrupted. The farther the control sleeve 14 is displaced upwardly, the greater the amount of fuel supplied by the injection pump. A full load stop member 30 is provided for limiting the pivotal motion of the lever 16. When the lever 16 engages the stop member 30, the maximum allowable fuel supply quantity is reached. Preferably the stop member 30 is a screw which is adjustable from outside of the pump housing 1. Also, the stop member 30 carries at its abutment end, a cam member 31 which provides an adjustable stop capability for the lever 16.

In order to adjust the fuel injection pump to the requirements of the engine, there is provided a device which controls or corrects the normal setting of the control sleeve 14. For this purpose there is provided a control lever 37 which is pivotable about a shaft 38 fixedly connected with the pump housing 1. The control lever 37 is shown in FIG. 1 as a two-armed lever, wherein the shaft 17 is mounted to the lever 37 and, is located between the shaft 38 and the control sleeve 14. Of course, it is also possible to develop a one-armed lever 37.

The control sleeve and the lever 37, is loaded by a compression spring 39 which is inserted into a bore 40 in the housing 1. The spring 39 urges the control lever 37 clockwise about the shaft 38 into engagement with an adjustable stop 43. When the stop 43 is displaced, the control lever 37 can be pivoted about the shaft 38 to a corresponding degree, which simultaneously causes a pivotal displacement of the shaft 17 of the intermediate lever 16. Preferably, the control lever 37 is continually subjected to a wall defined load, so that even in an arrangement wherein the shaft 8 is subjected to play, a displacement altering the normal setting of the control sleeve 14 cannot occur during operation. The extent of the arm of the control lever 37 extending from the shaft 38 to the adjustable stop 43 may be very large so that a very precise adjustment may be obtained.

Figure 2:
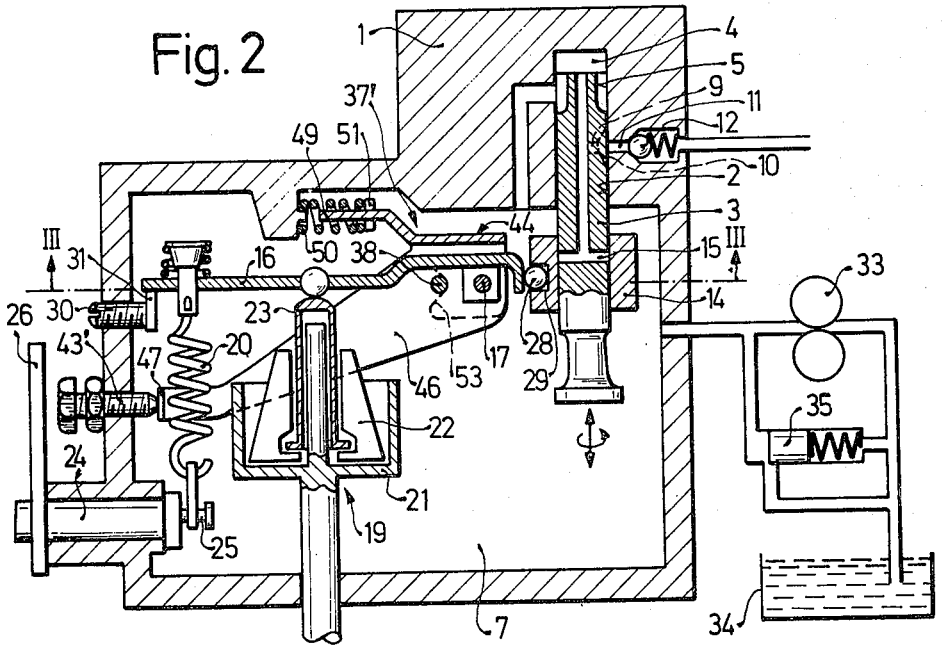
FIG. 2 is a schematic sectional view of another preferred embodiment of the present invention.

The exemplary embodiment of FIG. 2 is essentially developed similarly to the exemplary embodiment of FIG. 1 and differs only in the development of the control lever.

As in FIG. 1, the lever 37' is embodied as a two-armed lever, which is pivotably mounted on the shaft 38 and thereby changes the position of the shaft 17 of the intermediate lever 16. Also as in FIG. 1, the shaft 17 is parallel to the shaft 38 and is mounted on the control sleeve side of the control lever 37'. The lever 37' has a U-shaped median portion 44 (FIG. 3), whose side portions are traversed by the shaft 38 and shaft 17. One of the side portions of the U-shaped median portion 44 is developed as a lever arm 46. The free end of the lever 46 is provided with a bent end 47 which is displaceable from outside of the pump by a stop 43'. The stop 43' may be, like stop 43 in the exemplary embodiment of FIG. 1, i.e., it is preferably displaceable from outside of the pump and is embodied as an adjustable screw.

Figure 3:
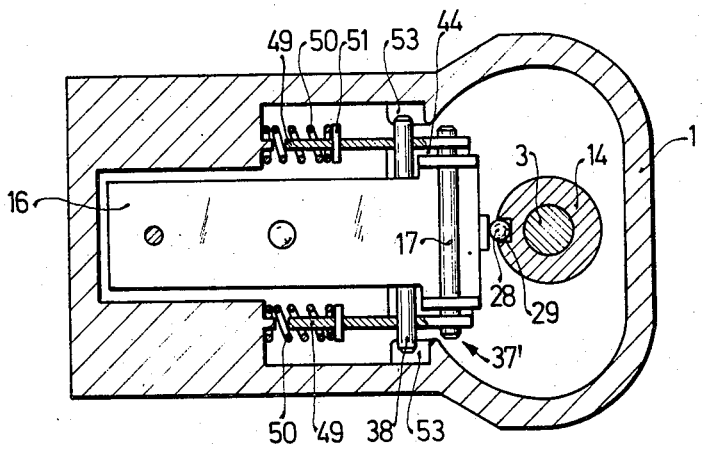
FIG. 3 is a cross-section view taken along the line 3—3 of FIG. 2.

Two arms 49 branch off from the base portion of the U-shaped median portion 44, so that the control lever 37' has substantially the configuration of an angular lever. The arms 49 serve, as can be seen in FIG. 3, for supporting one end of a compression spring 50. The other ends of the springs 50 are held against an extension of the pump housing 1. The arms 49 are provided with stops 51 against which the springs 50 exert a force which is transmitted to the control lever 37'. By the action of the compression springs 50, the control lever 37' is urged to rotate clockwise about its shaft 38, but is impeded by the stop 43'. Displacement of the stop 43' actuates rotation of the control lever 37' and thus displacement of the shaft 17.

The shaft 38 of the control lever 37' is pressed and held in two lateral V-shaped recesses 53 in the pump housing 1 by means of the compression springs 50. The V-shaped recesses are easily made by a die casting process and need no further processing. In this way a control lever arrangement is obtained at a greatly reduced cost. In addition, the customary sealing of the shaft, which is necessary when the shaft is inserted into mounting bores, may be dispensed with. Further, mounting is considerably simplified. By the action of the springs 50, the control lever 37' assumes a stationary position which is not altered by the operation of the engine. It can be only adjusted by means of a displaceable stop 43'. This cannot occur accidentally but only with the aid of the necessary tools. Then too, a very precise adjustment is possible because of the long lever arm which may extend over almost the entire width of the pump.

It is of course also possible in the exemplary embodiment of FIG. 1 for the shaft 38 to be arranged according to the exemplary embodiment of FIG. 2. Also, instead of two arms 49 and two corresponding springs 50 in the embodiment of FIG. 2, there may be only a single spring engaging the control lever 37'. Such an arrangement, however, will not give the most favorable results as in the exemplary embodiment of FIG. 2, where both ends of the shaft 38 are pressed into the recesses 53 by means of an evenly distributed force.

What is claimed is:

1. In an rpm regulator for use with a fuel injection pump associated with an internal combustion engine, said regulator having a housing, an intermediate lever, a regulating spring connected to the intermediate lever, and a device for generating an rpm signal and applying a corresponding force to the intermediate lever in opposition to a force exerted by the regulating spring, the improvement comprising:

a. a two-armed control lever;

b. a shaft pivotably mounting the intermediate lever to the control lever;

c. a further shaft pivotably mounting the control lever to the housing;

d. an adjustable stop mounted to the housing; and e. spring means mounted to the housing and engageable with the control lever for biasing the control lever against the adjustable stop, wherein one arm of said control lever engages said adjustable stop and the other arm engages said spring means.

2. An rpm regulator was defined in claim 1, wherein said shaft is mounted to said control lever between said further shaft and one end of the intermediate lever.

3. An rpm regulator as defined in claim 2, the improvement further comprising at least one V-shaped recess formed in the housing, wherein said further shaft is pressed by the spring means into said V-shaped recess.

4. An rpm regulator as defined in claim 3, wherein a pair of V-shaped recesses are formed in the housing, and wherein the spring means comprises a pair of springs associated with each one of the V-shaped recesses for pressing said further shaft into said V-shaped recesses.

5. An rpm regulator as defined in claim 2, wherein said other of said arms is configured as a pair of arms, and wherein each of said springs is engageable with a respective one of said pair of arms.

* * * * *